US006024811A

United States Patent [19]

Finck et al.

[11] Patent Number: 6,024,811

[45] Date of Patent: Feb. 15, 2000

[54] PYROTECHNIC COMPOSITION GENERATING CLEAN GASES WITH LOW LEVELS OF NITROGEN OXIDES, AND PELLETS OF SUCH A COMPOSITION

[75] Inventors: Bernard Finck, Corbeil; Jean-Paul Reynaud, Mennecy, both of France

[73] Assignee: Societe Nationale des Poudres et Explosifs, Paris Cedex, France

[21] Appl. No.: 09/204,466

[22] Filed: Dec. 3, 1998

[30] Foreign Application Priority Data

Dec. 22, 1997 [FR] France ..... 97 16216

[51] Int. Cl.[7] ..... C06B 31/28; C06B 31/02; C06B 29/22

[52] U.S. Cl. ..... 149/46; 149/61; 149/76

[58] Field of Search ..... 149/22, 36, 45, 149/46, 47, 61, 62, 75, 76

[56] References Cited

U.S. PATENT DOCUMENTS

| | | | |
|---|---|---|---|
| 3,725,516 | 4/1973 | Kaufman . | |
| 4,929,290 | 5/1990 | Cartwright . | |
| 5,035,757 | 7/1991 | Poole . | |
| 5,482,579 | 1/1996 | Ochi et al. . | |
| 5,525,171 | 6/1996 | Finck et al. . | |
| 5,536,339 | 7/1996 | Verneker . | |
| 5,545,272 | 8/1996 | Poole et al. . | |
| 5,608,183 | 3/1997 | Barnes et al. . | |
| 5,656,793 | 8/1997 | Ochi et al. . | |
| 5,670,740 | 9/1997 | Barnes et al. | 149/62 |
| 5,723,812 | 3/1998 | Berteleau et al. . | |
| 5,756,929 | 5/1998 | Lundstrom et al. | 149/22 |
| 5,773,754 | 6/1998 | Yamato | 149/36 |
| 5,780,768 | 7/1998 | Knowlton et al. | 149/36 |
| 5,898,126 | 4/1999 | Yoshida | 149/46 |
| 5,936,195 | 8/1999 | Wheatley | 149/19.91 |

FOREIGN PATENT DOCUMENTS

| | | |
|---|---|---|
| 0 619284 | 10/1994 | European Pat. Off. . |
| 0816307 | 1/1998 | European Pat. Off. . |
| WO9504710 | 2/1995 | WIPO . |
| WO9746500 | 12/1997 | WIPO . |

*Primary Examiner*—Charles T. Jordan
*Assistant Examiner*—Aileen J. Baker
*Attorney, Agent, or Firm*—Bucknam and Archer

[57] ABSTRACT

The present invention relates to gas-generating pyrotechnic compositions.

The compositions according to the invention contain a small amount of epoxy binder, stabilized ammonium nitrate, optionally potassium perchlorate or an organic oxidant containing nitrogen and, characteristically, a reactive organic nitrogen compound selected from nitroguanidine, guanidinium nitrate and oxamide. This reactive nitrogen compound may advantageously be combined with cupric oxide. The compositions according to the invention produce nitrogen-rich gases with very low levels of nitrogen oxides, and find their preferred application in the form of pellets as pyrotechnic charges in gas generators for pyrotechnic extinguishers, for devices designed to inflate external structures or for devices designed to protect the occupants of a motor vehicle.

10 Claims, No Drawings

PYROTECHNIC COMPOSITION GENERATING CLEAN GASES WITH LOW LEVELS OF NITROGEN OXIDES, AND PELLETS OF SUCH A COMPOSITION

FIELD OF THE INVENTION

The present invention relates to the field of the pyrotechnic production of gases which are intended for open systems. More precisely, the invention relates to novel pyrotechnic compositions generating clean gases which are rich in nitrogen but have a very small proportion of nitrogen oxides and are intended to operate fire extinguishers, to inflate external protective structures or air bags for occupants of a motor vehicle.

BACKGROUND OF THE PRIOR ART

For the pyrotechnic production of nitrogen-rich gases, attention has for a long time been paid to pyrotechnic compositions based on sodium nitride, for example those described in U.S. Pat. No. 4,929,290. However, compositions based on sodium nitride have a number of drawbacks. Firstly, when they combust, these composition generate a great deal of solid dust. It is therefore necessary, when this type of composition is used, to equip the gas generator with a sophisticated filtration device which increases the weight and cost of the generator. Furthermore, nitride-based compositions are very sensitive to humidity and have poor long-term stability. Lastly, since sodium nitride can cause primary explosions by combining with metals, for example to form lead nitride, these compositions require that precautions be taken during their manufacture and when disposing of waste.

For all these reasons, the person skilled in the art has sought to avoid sodium nitride and has targeted solid compositions which generate nitrogen and consist of a binder and an oxidant filler, which compositions have very good long-term stability.

The use of this type of composition as propellant for rocket and missile motors is known and has been described in a number of patents, for example U.S. Pat. No. 3,725,516 which describes rocket motor propellants consisting of a binder containing fluorine, an oxidant salt such as ammonium nitrate or potassium perchlorate and a metal in powder form.

However, such propellants cannot be used in the applications to which the present invention relates for at least two reasons. On the one hand, they contain a very high proportion of binder, often between 10 and 35%, and when they combust they therefore produce large amounts of highly toxic gases, and on the other hand they employ metal compounds which generate large amounts of solid residues.

In order to attempt to overcome these difficulties, the person skilled in the art has therefore proposed compositions based on ammonium nitrate and/or potassium perchlorate in combination with derivatives of tetrazole and metal compounds such as boron oxide, vanadium oxide or silicates. Such compositions which are, for example, described in U.S. Pat. No. 5,035,757 do indeed give nitrogen-rich non-toxic gases, but nevertheless produce a great deal of solid residues which make it necessary to have a powerful filtration system present.

Compositions based on cellulose acetate, ammonium nitrate and potassium perchlorate have also been proposed, for example in U.S. Pat. No. 5,462,579. Although such compositions do indeed lead to nitrogen-rich gases, in view of their high proportion of binder, these gases are often toxic because they are too rich in carbon monoxide. Furthermore, to achieve satisfactory combustion rates, the person skilled in the art is in practice forced to add metal oxides or metal powders, as indicated in this patent, and therefore is again confronted with the need to filter the combustion gases.

Compositions which expressly exclude the presence of metal compounds, and essentially comprise a thermoplastic binder containing oxygen, an energetic plasticizer such as polyglycidyl nitride and an oxidant filler composed for at least 85% of its weight by ammonium nitrate, have been proposed in U.S. Pat. No. 5,525,171.

However, in order for the charges formed in this way to have satisfactory mechanical strength, both immediately following manufacture and after prolonged ageing, it is in practice necessary for the composition to contain at least 8% by weight of binder, not to mention the energetic plasticizer and, at least for certain applications, the person skilled in the art is once again confronted with the problem of the gases' toxicity.

Compositions whose oxidant filler is based on ammonium nitrate and which contain less than 6% by weight of an organic binder containing oxygen and between 0.5% and 5% by weight of a light metal selected from the group consisting of boron and aluminium have therefore been proposed in patent application U.S. Ser. No. 08/874,634. These compositions, which are advantageously formed into pellets by compression, have a satisfactory combustion rate and do not produce heavy solid residues when they combust, and the gases which are generated have an extremely low level of carbon monoxide. Nevertheless, the gases which these compositions generate have a level of nitrogen oxides which is still a little too high when they are intended to operate in systems which are open to the outside.

SUMMARY OF THE INVENTION

The specific object of the present invention is to produce compositions of the type described in application U.S. Ser. No. 08/874,634 in such a way that, at the same time, they satisfy the following three criteria which are necessary for their use in the context of open systems:

good combustion rate, absence of heavy solid residues, gases having a very low level of nitrogen oxides.

The invention therefore relates to a pyrotechnic composition generating clean gases, comprising a cross-linkable organic binder containing oxygen, a light metal selected from the group consisting of boron and aluminium, potassium perchlorate, an oxidizing nitrogen compound selected from the group consisting of ammonium perchlorate, triaminoguanidine nitrate, hexogen, octogen and hexanitrohexaazaisowurtzitane, and ammonium nitrate in stabilized phase, characterized in that:

i) the proportion by weight x of the oxidizing nitrogen compound with respect to the total weight of the composition satisfies the relationship:
$0\% \leqq x \leqq 15\%$, ii) the proportion by weight of ammonium nitrate is between 29% and 93.5% of the total weight of the composition, iii) the said composition also comprises a reactive organic nitrogen compound selected from the group consisting of nitroguanidine, guanidinium nitrate and oxamide, the proportion by weight y of this reactive organic nitrogen compound with respect to the total weight of the composition satisfying the two-fold relationship:

$y \geqq 5\%$, $5\% \leqq x+y \leqq 30\%$.

In the present description, the symbol ≦ means "less than or equal to" and the symbol ≧ means "greater than or equal to".

More particularly, the proportions by weight of the main constituents with respect to the total weight of the composition are as follows:

from 1 to 9% as regards the cross-linkable organic binder containing oxygen, from 0.5 to 5% as regards the light metal, from 0 to 30% as regards the potassium perchlorate.

When the composition contains ammonium perchlorate as the oxidizing nitrogen compound, it will advantageously be combined with sodium nitrate which, during combustion, will act as a chlorine trap. In this case, the sodium nitrate/ammonium perchlorate weight ratio will advantageously be close to 0.95.

In order to improve their combustion rate, the compositions according to the invention will advantageously contain cupric oxide CuO, the proportion of which by weight with respect to the total weight of the composition may be as high as 10%.

The compositions according to the invention may also advantageously contain up to 5% by weight of lithium carbonate and up to 1% by weight of silica $SiO_2$. If compositions having a good combustion rate and producing gases with very low levels of nitrogen oxides are desired, care will be taken that these compositions contain cupric oxide as indicated above and that the said reactive nitrogen compound is nitroguanidine and/or guanidinium nitrate to the exclusion of oxamide. Such compositions are very suitable for forming pyrotechnic charges designed to inflate air bags to protect motor-vehicle occupants. In this case, the proportion by weight of the said reactive nitrogen compound will preferably be between 5% and 10% of the total weight of the composition, and more preferably close to 6%.

The compositions will be formed into tablets or chips by pelletizing, the cross-linkable binder containing oxygen being preferably selected from polymers or copolymers with epoxy units or silicone units. After pelletizing, the pellets obtained are baked for a few hours at a temperature close to 100° C. to cross-link the binder.

The pellets of cross-linked compositions are then intended to form loose charges in pyrotechnic gas generators for systems which are open to the outside, for example pyrotechnic extinguishers, devices designed to inflate external structures or air bags designed to protect the occupants of a motor vehicle.

A detailed description of a preferred embodiment of the invention is given below. The compositions according to the invention are therefore fundamentally composite pyrotechnic compositions which are based on ammonium nitrate and contain a binder and a light metal, such as the ones described in U.S. Ser. No. 08/874,634.

The binder is a cross-linkable binder containing oxygen, preferably selected from binders based on epoxy resin or based on silicone resin. The proportion by weight of the said binder with respect to the total weight of the composition will be between 1% and 6%.

The main oxidant of the compositions according to the invention is ammonium nitrate, the proportion of which by weight with respect to the total weight of the composition may, according to a first characteristic of the invention, be between 29% and 93.5%, but will preferably be between 60% and 75%. Advantageously, the ammonium nitrate will be stabilized ammonium nitrate, for example stabilized by potassium nitrate and amaranth, as described in U.S. Pat. No. 5,723,812. In this case, a stabilized mixture containing 96.5% by weight of ammonium nitrate, 3% by weight of potassium nitrate and 0.5% by weight of amaranth will advantageously be used.

The light metal is selected exclusively from boron and aluminium, and its proportion by weight with respect to the total weight of the composition is between 0.5% and 5%.

Besides ammonium nitrate, the compositions according to the invention may also contain other oxidants. They may thus contain potassium perchlorate, it being possible for the proportion of the latter by weight with respect to the total weight of the composition to be between 0% and 30%. This proportion by weight will often be between 10% and 20%. They may also contain an oxidizing nitrogen compound selected from the group consisting of ammonium perchlorate, triaminoguanidine nitrate, hexogen, octogen and hexanitrohexaazaisowurtzitane. The proportion by weight x of this oxidizing nitrogen compound with respect to the total weight of the composition satisfies the relationship $0\% \leqq x \leqq 15\%$. When ammonium perchlorate is used as the oxidizing nitrogen compound, it will advantageously be used in combination with sodium nitrate so as to avoid the formation of hydrochloric acid in the combustion gases. In this case, the sodium nitrate/ammonium perchlorate weight ratio will advantageously be close to 0.95.

According to a second essential characteristic of the invention, the pyrotechnic compositions necessarily contain a reactive organic nitrogen compound selected from the group consisting of nitroguanidine, guanidinium nitrate and oxamide. The proportion by weight y of this reactive nitrogen compound expressed with respect to the total weight of the composition satisfies the two-fold relationship:

$y \geqq 5\%$ and $5\% \leqq x+y \leqq 30\%$.

These reactive nitrogen compounds all contribute to increasing the proportion of nitrogen in the gases which are produced, and to lowering the proportion of nitrogen oxides in these gases.

The compositions according to the invention may also contain various additives, for example cupric oxide CuO, lithium carbonate $Li_2CO_3$ or silica $SiO_2$. These additives have various functions: silica, which will in general be used in proportions less than or equal to 1% by weight, has an anti-clumping effect on the ammonium nitrate during formulation and shaping of the composition before the binder is cross-linked. Lithium carbonate, which will in general be used in proportions less than or equal to 5% by weight, makes it possible to lower the combustion temperature of the compositions according to the invention, while cupric oxide, which will in general be used in proportions by weight less than or equal to 10%, most often close to 6%, makes it possible to improve the ignition of the compositions according to the invention and to increase their combustion rates.

The compositions intended for motor vehicle safety will therefore preferably contain cupric oxide. The gases intended to inflate air bags designed to protect occupants of a motor vehicle must not only contain very low levels of nitrogen oxides but must also contain very low levels of carbon monoxide CO. In order to satisfy this latter requirement, the use of oxamide as the reactive nitrogen compound will be avoided in compositions intended for motor vehicle safety, and for these compositions use will be restricted to nitroguanidine or guanidinium nitrate as the reactive nitrogen compound. Preferably, the proportion by weight of reactive nitrogen compound will, for these compositions, be between 5% and 10% with respect to the total weight of the composition, and more particularly close to 6%.

The compositions according to the invention are shaped by pelletizing after a mixing phase carried out in a blender.

The solid powder fillers consisting of ammonium nitrate, boron or aluminium, the nitrogen compounds mentioned above and, where appropriate, potassium perchlorate and possible solid additives are introduced into an open blender.

The binder containing oxygen is then added in the liquid state, incompletely polymerized. In the case of a thermosetting binder, this will be liquid resin mixed with curing agent. When the resin employed is a polyepoxy resin, the curing agent will advantageously be a polyamine which is unreactive so as to provide a pot life of about 24 hours for the binder.

Since one of the fundamental characteristics of the compositions according to the invention is that they contain only very little binder in comparison with the customary compositions intended for propellants or for low-vulnerability powders of the "LOVA" type, one not insignificant difficulty in formulating the compositions according to the invention consists in successfully impregnating all the solid constituents, and in particular the ammonium nitrate, with this small amount of liquid binder.

To this end, the liquid binder will advantageously be introduced into the blender in a form in which it is diluted in a highly volatile solvent which is inert with respect to the constituents of the composition. For example, with a polyepoxy binder, trichloroethane will advantageously be used as the diluent.

The blender is then turned on and left to run, with the chamber covered, for about one hour. Under these conditions, all of the solid constituents can be impregnated with the binder, and the diluent is eliminated in full by evaporation during the blending operation.

The composition, which at this stage has the appearance of a slightly moist powder, is shaped as desired by compression. In general, it is formed into pellets.

The binder is polymerized at a temperature close to 100° C. and, at the end of 7 hours in the case of a polyepoxy binder, the pyrotechnic charges which are obtained have good mechanical strength allowing them to be used in a pyrotechnic gas generator.

The compositions according to the invention contain a low proportion of binder which is not sufficient to fill all the gaps between the ammonium nitrate grains. For this reason, forming into pellets by compression leads to objects which have natural porosity, corresponding to an increase in the surface area available for combustion, and this is highly favourable in terms of the combustion rate of the composition.

Furthermore, the use of a stabilized ammonium nitrate as described above promotes the long-term preservation of the properties of the gas generator material.

Without implying any limitation, the following examples illustrate certain possible embodiments of the invention.

EXAMPLES 1 to 6

Pellets having the following compositions shown in Table 1 were prepared.

TABLE 1

| | Example 1 | Example 2 | Example 3 | Example 4 | Example 5 | Example 6 |
|---|---|---|---|---|---|---|
| Epoxy binder | 6 | 6 | 6 | 6 | 6 | 6 |
| Stabilized $NH_4NO_3$ | 71 | 62 | 71 | 71 | 62 | 62 |
| Boron | 3 | 1 | 1 | 1 | 1 | 1 |
| $KClO_4$ | 20 | 10 | 10 | — | 10 | 12 |
| $NH_4ClO_{4+NaNO3}$ | — | — | — | 10 | — | — |
| CuO | — | 6 | 6 | 6 | 6 | 6 |
| Nitroguanidine | — | 15 | 6 | 6 | — | — |
| Oxamide | — | — | — | — | 15 | 13 |

In this table, the proportions indicated are parts by weight.

Example 1 relates to a composition such as that described in French Patent Application 96,08050 and is given for comparison.

The pellets thus obtained were used to form pyrotechnic charges in gas generators intended to inflate 60 liter air bags. The firing results are given in Table No. 2, in which the following abbreviations have been used:

Tc=combustion temperature in K.

Rdt/Tc=gas yield (in liters/g) at the combustion temperature.

COppm=proportion of carbon monoxide in the gases at the outlet of the generator expressed in ppm.

NOxppm=proportion of nitrogen oxides in the gases at the outlet of the generator expressed in ppm.

TABLE 2

| | Example 1 | Example 2 | Example 3 | Example 4 | Example 5 | Example 6 |
|---|---|---|---|---|---|---|
| Tc | 2186 | 2311 | 2007 | 2010 | 2219 | 2289 |
| Rdt/TC | 5.61 | 6.32 | 5.53 | 5.71 | 6.12 | 6.10 |
| COppm | 85 | 513 | 29 | 30 | 19710 | 3056 |
| NOxppm | 4389 | 3791 | 2736 | 2649 | 56 | 703 |

Inspection of Tables 1 and 2 shows that all the compositions according to the invention (Examples 2 to 6) make it possible to lower the proportion of nitrogen oxides in the gases in comparison with the reference (Example 1), the most spectacular results being obtained with oxamide (Examples 5 and 6). However, the compositions with oxamide provide gases which are too rich in carbon monoxide for motor vehicle safety. It is the compositions which are rich in ammonium nitrate and use nitroguanidine (Examples 3 and 4) which provides the gases which are most advantageous for motor vehicle safety.

We claim:

1. Pyrotechnic composition generating clean gases, comprising a cross-linkable organic binder containing oxygen, a light metal selected from the group consisting of boron and aluminium, potassium perchlorate, an oxidizing nitrogen compound selected from the group consisting of ammonium perchlorate, triaminoguanidine nitrate, hexogen, octogen and hexanitrohexaazaisowurtzitane, and ammonium nitrate in stabilized phase, characterized in that:

i) the proportion by weight x of the oxidizing nitrogen compound with respect to the total weight of the composition satisfies the relationship:
$0\% \leqq x \leqq 15\%$, ii) the proportion by weight of ammonium nitrate is between 29% and 93.5% of the total weight of the composition, iii) the said composition also comprises a reactive organic nitrogen compound selected from the group consisting of nitroguanidine, guanidinium nitrate and oxamide, the proportion by weight y of this reactive organic nitrogen compound with respect to the total weight of the composition satisfying the two-fold relationship:
$y \geqq 5\%$,
$5\% \leqq x+y \leqq 30\%$.

2. Composition according to claim 1, characterized in that the ammonium perchlorate is combined with sodium nitrate.

3. Composition according to claim 2, characterized in that it contains up to 10% by weight of cupric oxide CuO.

4. Composition according to claim 2, characterized in that it contains up to 5% by weight of lithium carbonate $Li_2CO_3$.

5. Composition according to claim 2, characterized in that it contains up to 1% by weight of silica $SiO_2$.

6. Composition according to claim 3, characterized in that the said reactive organic nitrogen compound is selected from the group consisting of nitroguanidine and guanidinium nitrate.

7. Composition according to claim 6, characterized in that the proportion by weight y of the said reactive organic nitrogen compound is between 5% and 10% of the total weight of the composition.

8. Composition according to claim 7, characterized in that the proportion by weight y of the said reactive organic nitrogen compound is close to 6%.

9. Composition according to claim 1, characterized in that the cross-linkable organic binder containing oxygen is a polymer or a copolymer with an epoxy unit.

10. Pyrotechnic pellets generating clean gases, characterized in that they consist of a cross-linked pyrotechnic composition according to claim 1.

* * * * *